US006401508B1

(12) United States Patent
Getsay

(10) Patent No.: US 6,401,508 B1
(45) Date of Patent: Jun. 11, 2002

(54) COMPONENTS OF A HYDROFORMING MACHINE

(75) Inventor: James G. Getsay, Harmony, PA (US)

(73) Assignee: Wizenmann GmbH (DE)

( * ) Notice: Subject to any disclaimer, the term of this patent is extended or adjusted under 35 U.S.C. 154(b) by 0 days.

(21) Appl. No.: 09/816,476

(22) Filed: Mar. 26, 2001

(51) Int. Cl.[7] ..... B21D 15/10
(52) U.S. Cl. ..... 72/59; 72/370
(58) Field of Search ..... 72/58, 59, 370; 29/421.1

(56) References Cited

U.S. PATENT DOCUMENTS

| | | | | | |
|---|---|---|---|---|---|
| 1,600,750 | A | * | 9/1926 | Bezzenberger | 72/59 |
| 1,946,472 | A | * | 2/1934 | Babcock | 72/59 |
| 2,080,211 | A | * | 5/1937 | Mantle | 72/59 |
| 2,217,799 | A | * | 10/1940 | Giesler | 72/59 |
| 2,495,059 | A | * | 1/1950 | Grant | 29/421.1 |

FOREIGN PATENT DOCUMENTS

| | | | | |
|---|---|---|---|---|
| JP | 59-169630 | * | 9/1984 | 72/59 |

* cited by examiner

*Primary Examiner*—David Jones
(74) *Attorney, Agent, or Firm*—Volpe & Koenig, P.C.

(57) ABSTRACT

The components of a hydroforming machine include a die housing for containing a plurality of dies, a water distribution system, and a means for compressing the dies. The dies includes first and second die plates which are secured together by a key inserted into aligned keyways in each of the first and second die plates. The key is non-rotatable, such as being square shaped, rectangular, triangular, or the like for eliminating interference with adjacently positioned keys. The pins and links coupled to the die plates are held in position by keepers, which are elongated narrow pieces of metal positioned substantially parallel with the die plates and having a width approximately equal to the width of the die plates for allowing a person to view between the adjacent dies and into the die housing for observing formation of the bellows during the hydroforming process.

20 Claims, 4 Drawing Sheets

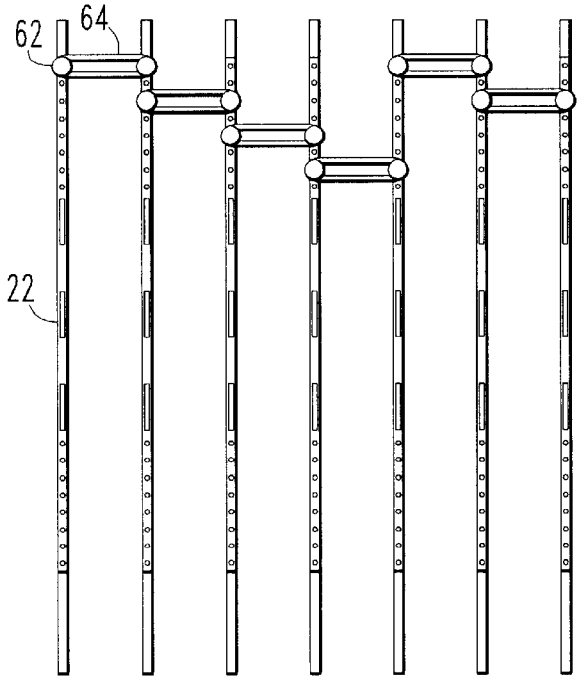
FIG. 4
FIG. 5
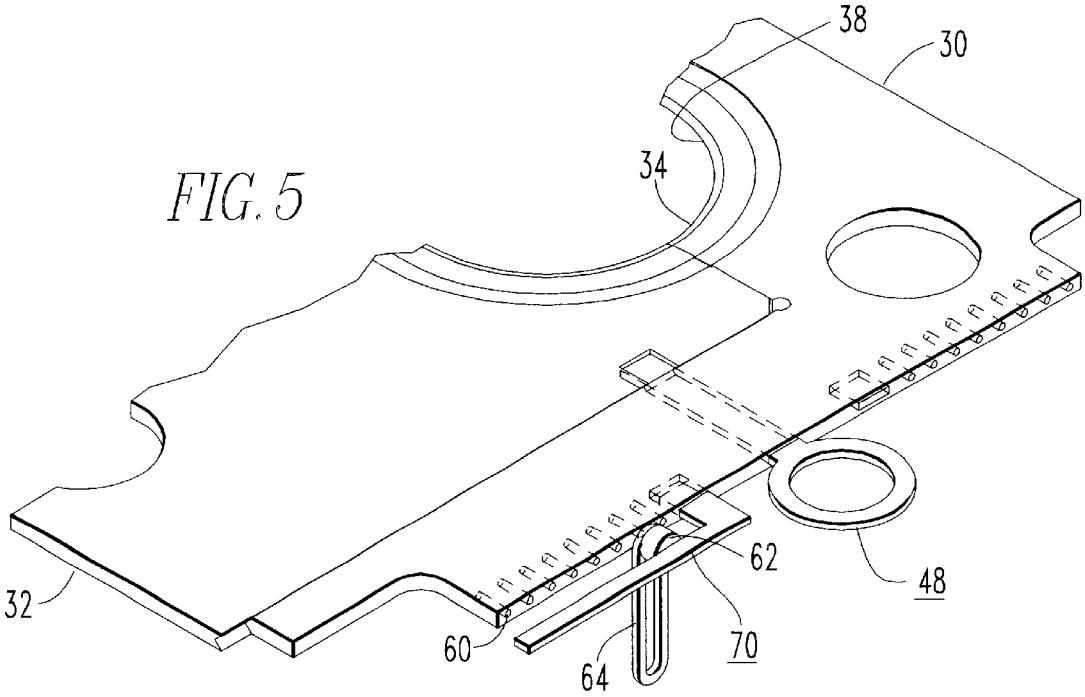

COMPONENTS OF A HYDROFORMING MACHINE

BACKGROUND OF THE INVENTION

The invention relates to hydroforming and, more particularly, to the components used during the hydroforming process for forming bellows.

Several processes may be used for forming pieces of metal into bellows, such as hydroforming, roll forming and an elastomeric process. During hvdroforming, a plurality of dies are positioned parallel and adjacent to one another. A hollow tube is inserted within the dies and held in position by the dies. As water is forced through the hollow tube, the water pressure against the tube expands the wall of the tube outwardly. The dies apply pressure against the wall of the tube at the desired locations along the length of the tube so that the wall of the tube is only expanded between adjacent dies. The dies are compressed together for forcing the expanded sections of the wall into a corrugated pattern for forming bellows.

Currently, the die is formed from two separate die plates. The two die plates may be separated for inserting the tube into the die. After the tube is inserted into the die, the die plates are clamped together around the tube. Previously, the two die plates were hydraulically held together. Alternatively, the two die plates have been held together by cylindrical keys. However, the inadvertent rotation of one of the keys, due to the cylindrical design of the keys, may interfere with an adjacent key.

Each of the dies contained within the die housing is held in position with respect to one another by pins and links. To hold each pin in position within the die requires a mechanical means. Previously, a solid sheet of metal contacted and retained each pin. However, the use of a solid piece of metal which contacted the pins and extended across the open space between adjacent dies obstructed the view into the die and prohibited an operator of the machine from viewing the bellows making process.

Therefore, what Is needed is an apparatus for making bellows which utilizes components which reduce interference with other components and enable an operator to observe the tube positioned within the dies during the bellows making process.

SUMMARY OF THE INVENTION

A hydroforming machine includes a die housing, a water distribution system coupled to the die housing, and a plurality of dies contained within the die housing. Each of the dies has a first die plate and a second die plate which are mateably connectable The first die plate has a first keyway and the second die plate has a second keyway which are alignable with respect to one another. A key is insertable into the aligned first and second keyways of the first and second die plates. The key has an elongated end and a handle end. The elongated end is non-rotatable and insertable into the first and second keyways. The handle end extends from the first and second keyways for enabling manual and automatic manipulation of the key.

The hydroforming machine also includes the first die plate having a plurality of apertures and at least one pin disposed within the apertures of the dies. A keeper is disposed within an opening of the first die plate and contacts the pin for retaining the pin within the apertures. The keeper has an elongated portion sized approximately equivalent in width as the die for enabling observation into the die housing during the hydroforming process.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

FIG. 4 is a side view of a plurality of dies attached together with pins and links;

FIG. 5 is an isometric view of the die with a keeper retaining the pin; and

DESCRIPTION OF THE PREFERRED EMBODIMENT

Figure 1:
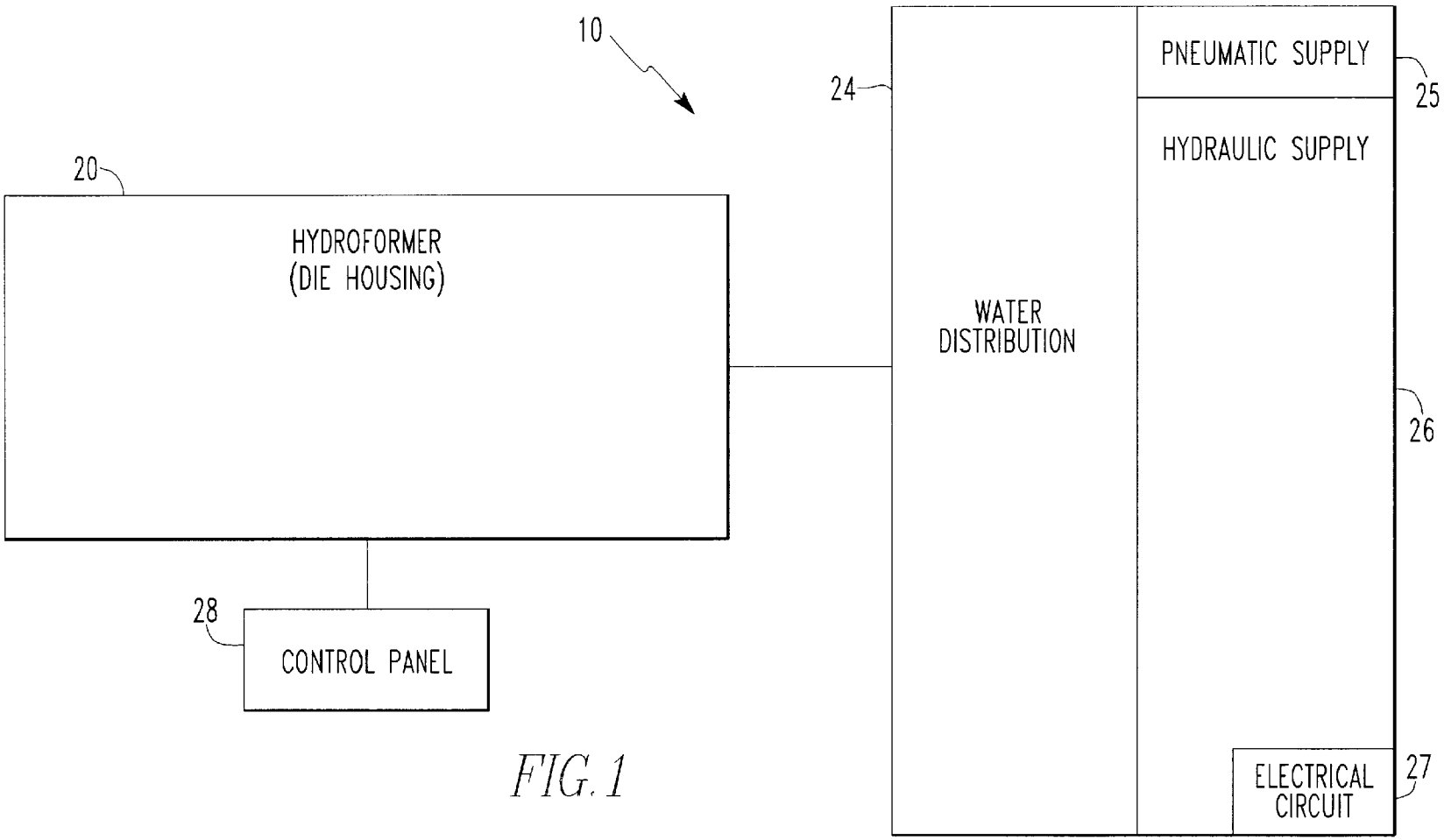
FIG. 1 is a schematic illustration of a hydroforming machine.

Referring to FIG. 1, one example of a hydroforming machine 10 includes a die housing 20 for housing a plurality of dies 22. The die housing 20 is connected to a water distribution system 24, which may supply water at various pressures and flow rates into a tube for making bellows. The hvdroforming machine 10 may also include a pneumatic supply 25, a hydraulic supply 26, an electrical circuit 27, and a control panel 28 for controlling and monitoring the hydroforming process.

Figure 2:
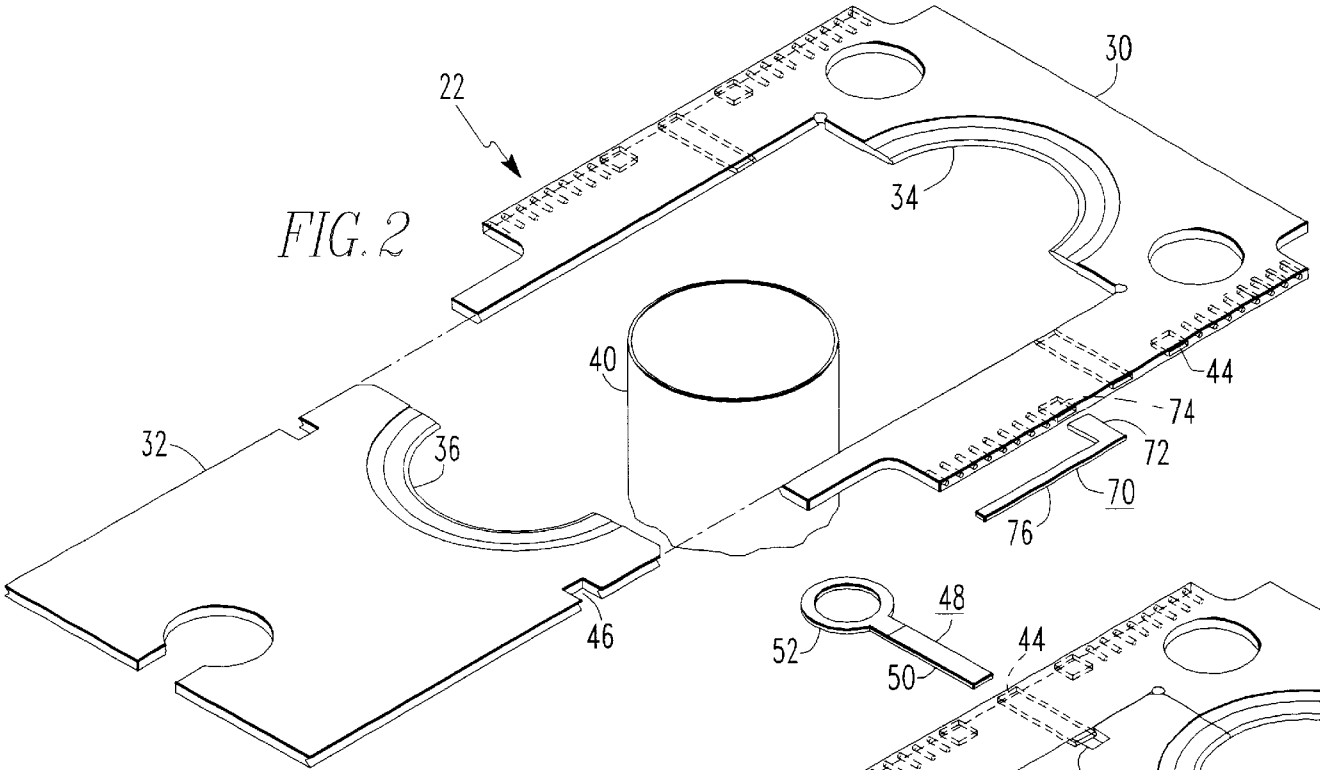
FIG. 2 is an exploded view of a die.
Figure 3:
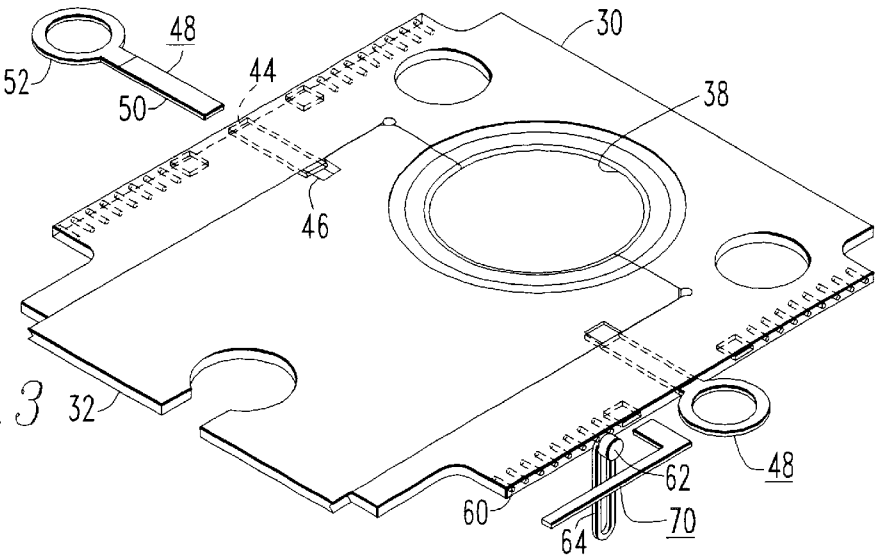
FIG. 3 is a view of the die illustrated in FIG. 2 in a closed position with a key inserted into each keyway.

Referring to FIGS. 2 and 3, each of the dies 22 is formed from a first die plate 30 and a second die plate 32. The die plates 30 and 32 may be mateably connected together, such as by sliding one die plate into the other, or may be connected together by any other suitable means. Each of the die plates 30 and 32 has an opening 34 and 36 respectively, which when the die plates 30 and 32 are positioned together, the openings 34 and 36 form a cylindrical hole 38. When the die plates 30 and 32 are separated from one another, a piece of material, such as a tube 40, may be inserted into the die 22. When the first and second die plates 30 and 32 are closed together, the tube 40 is contained within the cylindrical hole 38.

The first die plate 30 includes a first keyway 44 which is alignable with a second keyway 46 of the second die plate 32 when the two die plates 30 and 32 are closed together. A key 48 is insertable into the first and second keyways 44 and 46 for securing together the first and second die plates 30 and 32. The key 48 has an elongated portion 50 sized to fit within the first and second keyways 44 and 46. Preferably, the key 48 is non-rotating. For example, the elongated portion 50 may be square, rectangular, triangular or the like for preventing rotation of the key within the kenway.

The key 48 has a handle portion 52 for enabling an operator to grasp the handle portion 52 for manual insertion and removal of the key 48, or alternatively, for the key 48 to be mechanically inserted and removed into and out of the die plates 30 and 32. The handle portion 52 has an aperture therethrough for engagement with a rod (not shown). The rod may be inserted through the apertures of a plurality of the keys 48 and manipulated to simultaneously insert or remove the keys 48 from the dies 22. The handle portion 52 is sized approximately equivalent or smaller in width as the width of the die 22 for enabling observation into the die housing during the hydroforming process and for enabling the dies 22 to be compressed together without interference from adjacently positioned keys 48.

Referring to FIGS. 3, 4 and 5, the first and second die plates 30 and 32 include a plurality of apertures 60 for engagement with pins 62. Each pin 62 is inserted into one of the apertures 60 and retains a link 64. The pin 62 has a first end 66 sized for insertion into the apertures 60 and a second end 68 sized larger than the first end 62 for extending beyond the edge of the die 22 and for securing the link 64 to the die 22. The link 64 connects and evenly spaces each of the adjacent dies 22.

The pins 62 and links 64 may be staggered with respect to adjacent dies 22 for enabling the dies 22 to be compressed closely together. The pins 62 are retained within the die 22 by a keeper 70. The keeper 70 is a device which retains the pins 62 within the apertures 60 and allows the operator of the machine to view the bellows forming process through the dies 22 positioned within the die housing 20. The operator may visually observe the process by looking between adjacent positioned dies 22 and see the tube 40. As one example and referring to FIG. 5, the keeper 70 may be an angled piece of metal having a first end 72 which is inserted into an opening, such as slot 74 in the die 22 for retaining the position of the keeper 70 with respect to the die 22 and the pin 62. The keeper 70 has a second end 76 positioned approximately perpendicular to the first end 72 for contacting the pin 62 and holding the pin 62 within the aperture 60 of the die 22. The second end 76 is an elongated narrow portion being sized approximately the width of the dies 22. Since the width of the second end 76 is sized approximately equal to the Width of the dies 22, the keeper 70 does not extend into the space positioned between adjacent dies 22, thereby allowing an observer to view into the die housing and view the tube 40 during the hydroforming process.

For the various embodiments of this invention, the same reference characters will be used to designate like parts. In addition, like functions and like interactions of the parts among the various embodiments of this invention will not be repeated for each embodiment.

Figure 6:
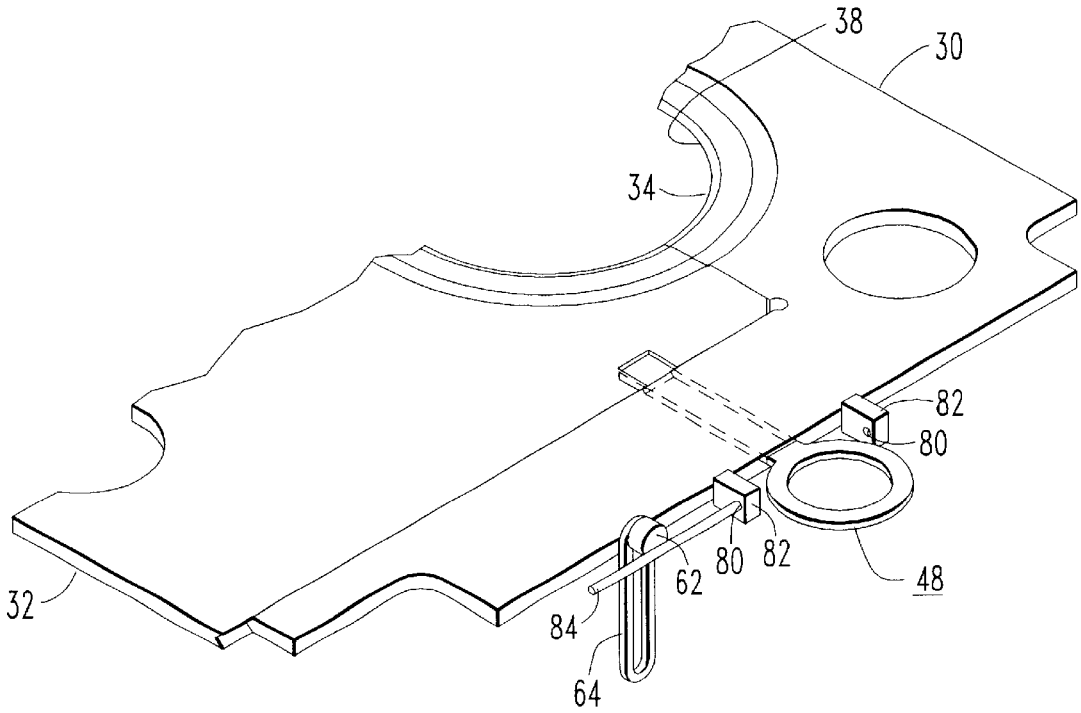
FIG. 6 is a view of an alternative embodiment of the keeper.

Referring to FIG. 6 and using the same reference characters to define like parts, an alternative embodiment of the keeper 70 may be a keeper 84 having a protuberance 82 integrally formed with the die 22. The protuberance 82 has a hole 80 therethrough which extends perpendicular to the hole 34. The keeper 84, such as an elongated narrow rod, is inserted through the hole 80 of the protuberance 82 and extends parallel to the die 22 for contacting pin 62 and securing the pin 62 to the die.

In operation, the die plates 30 and 32 are assembled within the die housing 20. Adjacently positioned dies are held together by the pins 62 and movable links 64 for enabling the dies to be compressed together. After the links 64 and pins 62 are connected to each adjacent die 22 and each keeper 70 is installed, the first die plates 30 are separated from the second die plates 32 and the tube 40 is placed therebetween. The first and second die plates 30 and 32 are closed together about the tube 40. The keys 48 are inserted into the keyways 44 and 46.

When the water from the water distribution system 24 is directed into the tube 40, the water pressure forces the wall of the tube 40 outwardly. At the same time, the dies 22, which are evenly spaced along the length of the tube 40, contain the tube 40 at each desired location of each of the dies 22 along the tube 40. As the wall of the tube 40 is forced outwardly between the adjacent dies 22, the dies 22 are compressed within the die housing 20 for forming the bellows.

An advantage of the die 22 is that the key 48 is non-rotating and therefore does not interfere with adjacent keys 48. The key 48 remains is a fixed position and securely retains the die plates 30 and 32 together.

Another advantage of the die 22 is that the pins 62 are firmly held in position by the keeper 70 or 80. Since the keeper 70 or 80 is a small thin piece of material which aligns with the die 22, the operator of the machine can visually observe the bellows forming process and is not visually obstructed by the components of the machine.

Thus there has been shown and described novel components of a hydroforming machine which fulfills all the objects and advantages sought therefor. Many changes, modilfications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A hydroforming machine, comprising:

a die housing;

a water distribution system coupled to said die housing;

a plurality of dies contained within said die housing, each of said dies having a first die plate and a second die plate which are matably connectable, said first die plate having a first keyway and said second die plate having a second keyway which are alignable with respect to one another; and a key insertable into said aligned first and second keyways of said first and second die plates, said key having an elongated end and a handle end, said elongated end is non-rotatable for insertion into the first and second keyways, said handle end extends from said first and second keyways for enabling manual and automatic manipulation of said key.

2. The hydroforming machine according to claim 1, further comprising:

said first die plate having a plurality of apertures and at least one opening;

at least one pin disposed within said plurality of apertures of said dies; and a keeper disposed within said at least one opening and contacting said at least one pin for retaining said at least one pin within said plurality of apertures, said keeper having an elongated portion sized approximately equivalent in width as the width of said die for enabling observation into the die housing during the hydroforming process.

3. The hydroforming machine according to claim 1, wherein said elongated end of said key and said first and said second keyways are square shaped.

4. The hydroforming machine according to claim 1, wherein said elongated end of said key and said first and said second keyways are triagularly shaped.

5. The hydroforming machine according to claim 2, wherein said keeper has a first end insertable into said first die plate and a second end having said elongated portion positioned substantially perpendicular to said first end.

6. The hydroforming machine according to claim 2, wherein when said keeper is attached to said die, said keeper is positioned approximately parallel with said first die plate.

7. A hydroforming machine, comprising:

a die housing;

a water distribution system coupled to said die housing;

a plurality of dies contained within said die housing, each of said dies having a first die plate and a second die plate which are matably connectable, said first die plate having a plurality of apertures and at least one opening;

at least one pin disposed within said plurality of apertures of said dies; and a keeper disposed within said at least one opening and contacting said at least one pin for retaining said at least one pin within said plurality of apertures, said keeper having an elongated portion sized approximately equivalent in width as the width of said die for enabling observation into the die housing during the hydroforming process.

8. The hydroforming machine according to claim 7, further comprising:

said first die plate having a first keyway and said second die plate having a second keyway which are alignable with respect to one another; and a key insertable into said aligned first and second keyways of said first and second die plates, said key having an elongated end and a handle end, said elongated end is non-rotatable for insertion into the first and second keyways, said handle end extends from said first and second keyways for enabling manual and automatic manipulation of said key.

9. The hydroforming machine according to claim 8, wherein said elongated end of said key and said first and said second keyways are square shaped.

10. The hydroforming machine according to claim 8, wherein said elongated end of said key and said first and said second keyways are triagularly shaped.

11. The hydroforming machine according to claim 7, wherein said keeper has a first end insertable into said first die plate and a second end having said elongated portion positioned substantially perpendicular to said first end.

12. The hydroforming machine according to claim 7, wherein when said keeper is attached to said die, said keeper is positioned approximately parallel with said first die plate.

13. Components of a die, comprising:

a first die plate having a first keyway;

a second die plate matably connectable with said first die plate, said second die plate having a second keyway which is alignable with said first keyway of said first die plate; and a key insertable into said aligned first and second keyways of said first and second die plates, said key having an elongated end and a handle end, said elongated end is non-rotatable for insertion into the first and second keyways, said handle end extends from said first and second keyways for enabling manual and automatic manipulation of said key.

14. The components according to claim 13, further comprising:

at least one pin attached to said first die plate; and a keeper attached to said first die plate and positioned contacting said at least one pin for coupling together components of said die, said keeper having an elongated portion sized approximately equivalent in width as the width of said first and second die plates for enabling observation between adjacent said die plates during use of said die.

15. The components according to claim 13, wherein said elongated end of said key and said first and said second keyways are rectangularly shaped.

16. The components according to claim 13, wherein said handle end of said key is sized approximately smaller in width as the width of said die.

17. Components of a die, comprising:

a first die plate;

a second die plate matably connectable with said first die plate;

at least one pin attached to said first die plate; and a keeper attached to said first die plate and positioned contacting said at least one pin for coupling together components of said die, said keeper having an elongated portion sized approximately equivalent in width as the width of said first and second die plates for enabling observation between adjacent said die plates during use of said die.

18. The components according to claim 15, further comprising:

said first die plate having a first keyway;

said second die plate having a second keyway which is alignable with respect to said first keyway of said first die plate; and a key insertable into said aligned first and second keyways of said first and second die plates, said key having an elongated end and a handle end, said elongated end is non-rotatable for insertion into the first and second keyways, said handle end extends from said first and second keyways for enabling manual and automatic manipulation of said key.

19. The components according to claim 17, wherein:

said first die plate has a plurality of apertures and at least one opening;

said at least one pin is disposed within said plurality of apertures of said first die plate; and said keeper disposed within said at least one opening of said first die plate for securing said keeper to said die plate.

20. The components according to claim 17, further comprising:

a protuberance integrally formed with said first die plate and having a hole therethrough; and said keeper disposed through said hole of said protuberance.

* * * * *